US006896095B2

(12) United States Patent
Shah et al.

(10) Patent No.: US 6,896,095 B2
(45) Date of Patent: May 24, 2005

(54) FAN SHROUD WITH BUILT IN NOISE REDUCTION

(75) Inventors: Hemant S. Shah, Livonia, MI (US); John Stuart Hollingshead, Dearborn, MI (US); John Wang, Ann Arbor, MI (US); Prakash Tuljaram Thawani, Bloomfield Hills, MI (US); Richard Charles Kosik, Plymouth, MI (US); Mukesh Kumar, Canton, MI (US)

(73) Assignee: Ford Motor Company, Dearborn, MI (US)

( * ) Notice: Subject to any disclaimer, the term of this patent is extended or adjusted under 35 U.S.C. 154(b) by 55 days.

(21) Appl. No.: 10/063,151

(22) Filed: Mar. 26, 2002

(65) Prior Publication Data

US 2003/0183446 A1 Oct. 2, 2003

(51) Int. Cl.[7] ..... A47B 81/06; F04D 29/66

(52) U.S. Cl. ..... 181/198; 181/199; 181/205; 415/119

(58) Field of Search ..... 181/198, 199, 181/205; 415/119, 170.1, 169.1, 230; 416/189, 500; 123/41.49

(56) References Cited

U.S. PATENT DOCUMENTS

| | | | | |
|---|---|---|---|---|
| 4,596,921 A | * | 6/1986 | Hersh et al. | 392/385 |
| 4,650,729 A | | 3/1987 | Nakamura et al. | |
| 4,692,091 A | * | 9/1987 | Ritenour | 415/119 |
| 5,096,013 A | * | 3/1992 | Yoshida et al. | 180/117 |
| 5,248,566 A | | 9/1993 | Kumar et al. | |
| 5,410,992 A | | 5/1995 | Hunt et al. | |
| 5,518,364 A | | 5/1996 | Neise et al. | |
| 5,590,849 A | * | 1/1997 | Pla | 244/1 N |
| 5,625,172 A | | 4/1997 | Blichmann et al. | |
| 5,636,287 A | | 6/1997 | Kubli et al. | |
| 5,638,454 A | | 6/1997 | Jones et al. | |
| 5,638,940 A | * | 6/1997 | Aoyama et al. | 198/493 |
| 5,760,348 A | | 6/1998 | Heuser | |
| 5,783,780 A | | 7/1998 | Watanabe et al. | |
| 5,869,792 A | | 2/1999 | Allen et al. | |
| 5,912,821 A | | 6/1999 | Kobayashi | |
| 5,979,593 A | * | 11/1999 | Rice et al. | 181/207 |
| 5,979,598 A | | 11/1999 | Wolf et al. | |
| 6,027,307 A | | 2/2000 | Cho et al. | |
| 6,048,386 A | | 4/2000 | Gillingham et al. | |
| 6,054,229 A | | 4/2000 | Hsu et al. | |

(Continued)

FOREIGN PATENT DOCUMENTS

| | | | | |
|---|---|---|---|---|
| EP | 1128071 A2 | | 8/2001 | |
| JP | 07011956 A | * | 1/1995 | F01P/11/10 |
| JP | 08114120 A | * | 5/1996 | F01P/11/10 |
| JP | 08136004 A | * | 5/1996 | F24F/5/00 |
| JP | 08158968 A | * | 6/1996 | F02M/35/12 |
| JP | 11093670 A | * | 4/1999 | F01P/11/10 |
| JP | 2001317358 A | * | 11/2001 | F01P/11/10 |

*Primary Examiner*—Rina Duda
*Assistant Examiner*—Patrick Miller
(74) *Attorney, Agent, or Firm*—Randy Tung & Assoc.; Carlos L. Hanze

(57) ABSTRACT

The present invention is a system and method to significantly reduce noise associated with air-moving devices such as an axial flow fan using a fan shroud and barrel combination with built in silencers such as Helmholtz resonators. The invention can be applied to a variety of applications such as a thermal management system for a fuel cell powered vehicle. The resonator can be a hollow cavity in networks attached to an outer or inner barrel or shroud and tuned to reduce noise at predetermined noise frequency ranges within the airflow. The invention can also attach stator members on the inner surface of the outer barrel to further reduce noise. Additional sound absorbing material, such as steel wool, can be disposed within the resonator cavity.

15 Claims, 6 Drawing Sheets

U.S. PATENT DOCUMENTS 6,082,969 A 7/2000 Carroll et al.
6,104,608 A 8/2000 Casinelli et al.
6,112,850 A 9/2000 Secrest et al.
6,123,051 A 9/2000 Kubina et al.
6,188,770 B1 2/2001 Okada
6,206,635 B1 3/2001 Golm et al.
6,244,817 B1 * 6/2001 Ngo ..... 415/119
6,270,385 B1 8/2001 Varney et al.
6,309,176 B1 * 10/2001 Periyathamby et al. ..... 415/119
6,379,110 B1 * 4/2002 McCormick et al. ..... 415/119
6,390,770 B1 * 5/2002 Takeshita ..... 415/119
2001/0018022 A1 8/2001 Nakamura
2002/0015640 A1 * 2/2002 Nishiyama et al. ..... 415/119

* cited by examiner

FAN SHROUD WITH BUILT IN NOISE REDUCTION

BACKGROUND OF INVENTION

The present invention relates generally to silencers for air-moving devices and specifically to a method and apparatus to reduce fan noise of a thermal management system using resonators integrated with fan shrouds and barrels.

In an effort to find new energy sources, fuel cells using an electrochemical reaction to generate electricity are becoming an attractive energy alternative. Fuel cells offer low emissions, high fuel energy conversion efficiencies, and low noise and vibrations. U.S. Pat. No. 5,248,566 to Kumar et al. These advantages make fuel cells useful in automotive applications. Of the various types of fuel cell types, the proton electrolyte membrane (PEM) fuel cell appears to be the most suitable for use in automobiles, as it can produce potentially high energy, but has low weight and volume.

One design challenge for a vehicle with a PEM fuel cell stack is the high amount of heat it produces while in operation. Thermal management systems (coolant systems) are known both for conventional vehicles and even for fuel cell vehicles. A fan is usually situated behind a heat exchanger such as a radiator to draw a large quantity of air through the radiator to cool a coolant that travels through a closed loop from the fuel cell stack. Similar configurations exist for coolant systems of internal combustion engines.

Unfortunately, noise levels associated with powerful fuel cell coolant system fans are often much higher than acceptable to most operators. Successful implementation of a fuel cell vehicle will require a system and method to significantly reduce this fan noise. Reduced noise would also benefit any coolant system using a fan or fans.

Devices are known in the prior art to reduce fan noise in vehicle coolant systems. U.S. Pat. No. 6,082,969 to Carroll et al. describes forwardly skewed fan blades of an axial flow fan behind a radiator with an increasing blade angle to reduce noise levels. Enclosures using ducts or baffles can also reduce sound/noise but are generally impractical for vehicle applications due to their large size especially if designed to reduce low frequency noise levels. See generally, U.S. Pat. No. 5,625,172 to Blichmann et al.

Noise reduction using a tuned Helmholtz resonator is also known in the art. The resonator has an air space (volume) that communicates with the "outer air" through an opening. An air plug present in the opening forms a mass that resonates on support of the spring force formed by the air enclosed in the hollow space/cavity. The resonant frequency of the Helmholtz resonator depends on the area of the opening, on the volume of the air space, and on the effective length of the air plug formed in the opening. When either the volume of the air space or the effective length of the air plug becomes larger, the resonant frequency is shifted toward lower frequencies. When the area of the opening is made smaller, the resonant frequency is shifted towards lower frequencies.

When Helmholtz resonators are driven with acoustic energy at a resonant frequency, the resonators will absorb a maximum amount of the incoming acoustic energy. Nevertheless, because they are tuned systems, the absorption decreases as the frequency of the incoming acoustic energy varies from the predetermined resonant frequency. Thus, the principle limitation with these devices is their ability to attenuate sound energy efficiently only within a limited frequency range. Therefore, to work effectively, a plurality of differently tuned Helmholtz resonators would be needed for broadband noise applications.

The capability of Helmholtz resonators to attenuate noise in long pipes had been demonstrated in internal combustion engine air intake and exhaust systems. It is unknown in the art to use Helmholtz resonators in a shroud around an air-moving device such as a fan placed near a radiator of a vehicle coolant system. This would provide an effective and low cost means to reduce fan noise associated with these applications.

SUMMARY OF INVENTION

Accordingly, an object of the present invention is to provide a system and method to significantly reduce noise associated with air-moving devices such as an electric and/or engine driven axial flow fan or fans (fan).

Specifically, the present invention is a shroud with a barrel having attached silencers such as Helmholtz resonators to significantly reduce noise associated with airflow and air-moving devices. The invention can be applied to a variety of applications such as a thermal management system for a fuel cell powered vehicle and made from a variety of materials such as plastic or metal. The shroud can, be attached to a heat exchanger or similar structures using various attachment means such as welding, molding, or bolting.

The present invention is a method and system for noise reduction from an air-moving device, comprising: a shroud with an outer barrel surrounding the fan(s) and defining an airflow area; at least one noise silencer (such as a Helmholtz resonator) comprising at least one resonator cavity; at least one noise silencer having an opening exposed to the airflow; and the noise silencer disposed around the outer barrel surface or shroud and tuned to attenuate predetermined frequency bands within the airborne noise. The outer barrel can be configured to extend upstream or downstream the air-moving device or both.

An inner barrel can be added to attach downstream to the fan motor(s) with at least one noise silencer disposed within it.

The noise silencers can further comprise pipes attached to the outer barrel or shroud in a variety of configurations to connect the airflow to the resonator cavity.

The silencers can be predetermined to include broadband and narrowband applications, or both. The silencers can be configured to be in a parallel or series configuration.

Additional embodiments can also include sound absorbing material such as steel wool disposed/lined within the resonator cavity.

Other objects of the present invention will become more apparent to persons having ordinary skill in the art to which the present invention pertains from the following description taken in conjunction with the accompanying figures.

BRIEF DESCRIPTION OF DRAWINGS

The foregoing objects, advantages, and features, as well as other objects and advantages, will become apparent with reference to the description and figures below, in which like numerals represent like elements and in which.

DETAILED DESCRIPTION

The present invention relates to a method and system to effectively reduce noise produced by air-moving devices such as an axial flow electric (or engine driven) fan or fans (fan) used in thermal management systems in vehicle applications. The present invention incorporates Helmholtz resonators connected to an airflow and disposed around a shroud or barrel. Stators may also be used. Many possible variations of the invention are possible. Broadband or narrowband Helmholtz silencers can be used.

Figure 1:
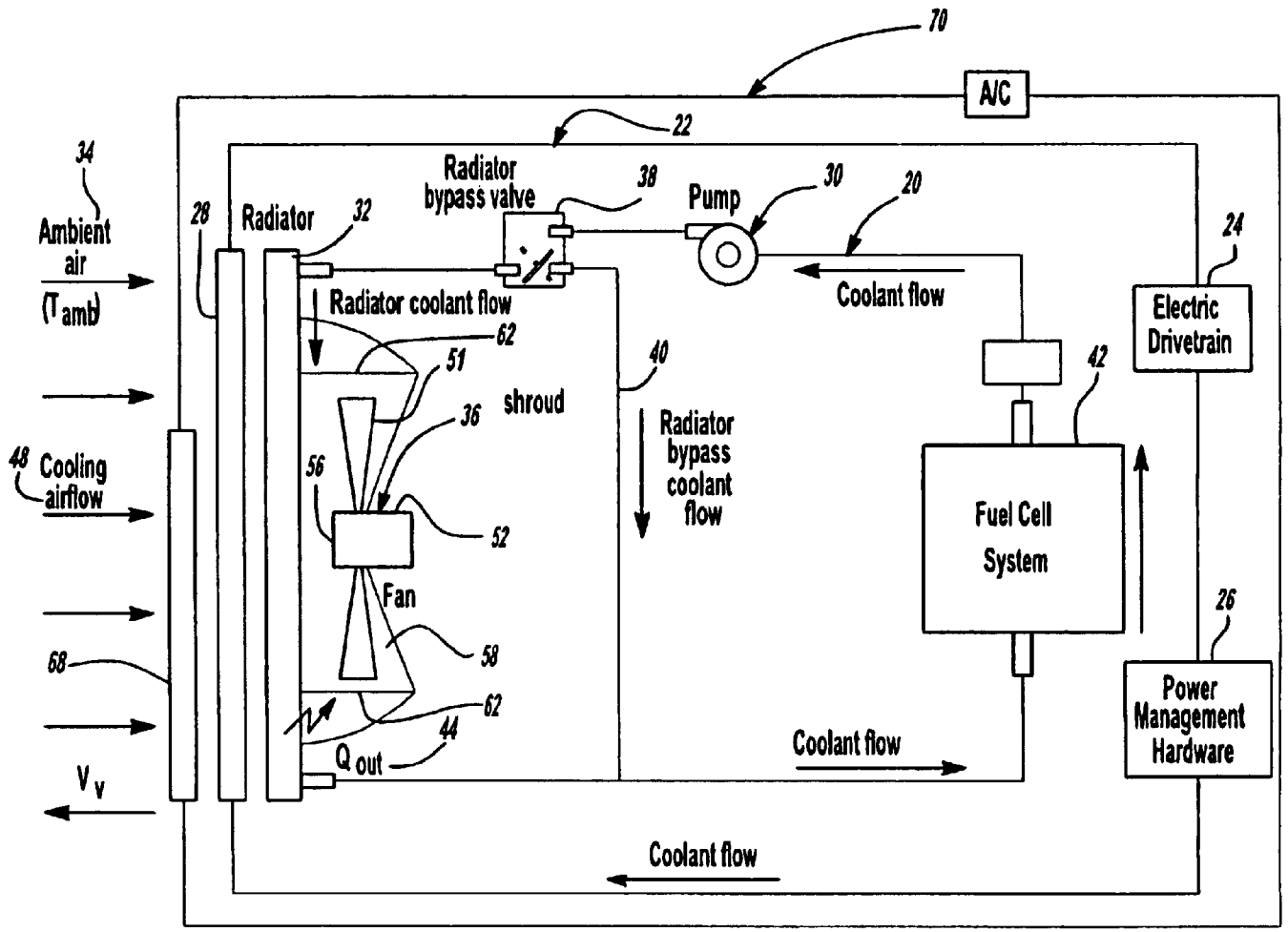
Fig-1 (Prior Art)
FIG. 1 illustrates a general schematic of a possible prior art fuel cell system including a thermal management system.

To assist in understanding the present invention, FIG. 1 illustrates a schematic of a possible thermal management system of a fuel cell powered vehicle that could use the invention. It is noted though that the invention could be applied to any application using an axial flow fan.

In FIG. 1 two independent cooling circuits (loops) are used to cool a fuel cell system 42 and all other liquid cooled components on the vehicle. They include a high temperature cooling loop 20 and a low temperature cooling loop 22. The fuel cell system 42 and several associated system components can be cooled with the high temperature cooling loop 20. The low temperature cooling loop 22 has a heat exchanger, a low temperature cooling loop radiator 28, with an inlet and an outlet to allow exit and entry of coolant and can be used to thermally manage some auxiliary vehicle components such as auxiliary fuel cell system 42 components, an electric drivetrain 24 and its power management hardware 26. The low temperature cooling loop 22 can also have a pump (not shown) to move coolant through a plurality of conduits from a second heat exchanger, the low temperature cooling loop radiator 28 and through the various cooled components.

On the high temperature cooling loop 20, fuel cell system 42 waste heat is removed by coolant (not shown) and transported through the loop via several conduit means (as illustrated in FIG. 1) such as hoses, piping, etc. through the action of a variable speed pump 30 to a high temperature cooling loop radiator 32 having an inlet and an outlet and/or a radiator bypass 40, where it is removed from the vehicle as waste heat 44 by a cooling airflow 48. The flow of coolant is also controlled by a variable high temperature cooling loop radiator bypass valve 38. This bypass valve 38 controls the amount of coolant flow between the high temperature cooling loop radiator 32 and the high temperature cooling loop radiator bypass 40. The cooling airflow 48 varies based on vehicle speed and ambient air temperature 34, and can be increased by the action of one or more air-moving devices or fans (fan) 36. The fan 36 for the present invention has variable speeds and generates an axial flow. Other embodiments of the present invention can add additional fans as needed to meet thermal exchange and packaging requirements. In FIG. 1, the fan 36 is also used by a third heat exchanger, an air-conditioning (A/C) system 70 to cool an A/C condenser 68.

FIG. 1 demonstrates the complexity of a fuel cell thermal management system. This system has three heat exchangers. Obviously, the fan or fans 36 must be able to move a large quantity of air to provide a sufficient cooling airflow in a small amount of space. To improve airflow past the heat exchangers, a fan shroud 50 and outer barrel 62 can be added to direct the flow of this large amount of air. The present invention provides a system and method to reduce noise associated with the movement of air through this fan shroud 50 and outer barrel 62.

One possible means to reduce high frequency noise in an airflow system is to use absorptive type silencers. Absorptive silencers are the most common type of silencer for commercial and industrial uses and use of lined ducts disposed parallel to the flow of air (or any fluid for that matter).

There are a number of design restrictions associated with absorptive type silencers. First, the introduction of a baffle within the duct poses a restriction to the airflow and hence introduces a static pressure loss to the system. This need for additional pressure adds more weight to the fan. The pressure loss increases with the velocity of air flowing through the silencer.

Another possible embodiment of a fan shroud 50 of the present invention can add at least one or a series of Helmholtz resonator(s) known in the art to the outer barrel 62. This type of duct silencer is a device inserted into a ventilation duct or exhaust duct to reduce airflow noise. The Helmholtz resonator has a hollow air space that communicates with the "outer air" along the wall of a duct or shroud through an opening. An air plug present in the opening forms a mass that resonates on support of a spring force formed by the air enclosed in the hollow space. The Helmholtz resonator must be tuned to a specific wavelength frequency of the sound to be attenuated. This resonant frequency is a function of the area of an opening, on the volume of the air space, and on the length of the air plug formed in the opening. Additionally, a noise absorbing material (using steel wool for example) can also be added to the hollow space.

There are mainly three obstacles that need to be overcome to reduce fan noise using Helmholtz resonators. First, the fan speed can be variable, i.e., it may run at any speed between several hundred RPM to several thousand RPM. That will generate noise from several Hz to several thousands Hz. Therefore, broadband resonator networks are needed to cover a wide range of frequencies. Secondly, the acoustic fields near the fan 36, shroud 50, and outer barrel 62 are different from the acoustic fields in long pipes. The shroud 50, outer barrel 62, and stators if present, need to be configured in such a way that the acoustic fields are alike, so that the resonator networks can efficiently attenuate the noise. Extending barrels and adding pipes in, for example, tangential or spiral arrays can be employed for this purpose. This is a challenging task due the packaging limitation. Thirdly, the wavelength of high frequency components of the fan noise might be shorter than the radius of the barrel, i.e., it is not a single plane wave. Therefore, several resonators with the same frequency range may need to be placed around the outer barrel to reduce high frequency noise. An inner barrel with resonators may also need to be built behind the fan. Fortunately, the size of these high frequency resonators tends to be small.

For the present invention, design concerns involve space limitations surrounding the thermal management system; since a vehicle fan 36 typically has a shroud 50 and outer barrel 62 to guide air from or to the vehicle heat exchangers.

Figure 2:
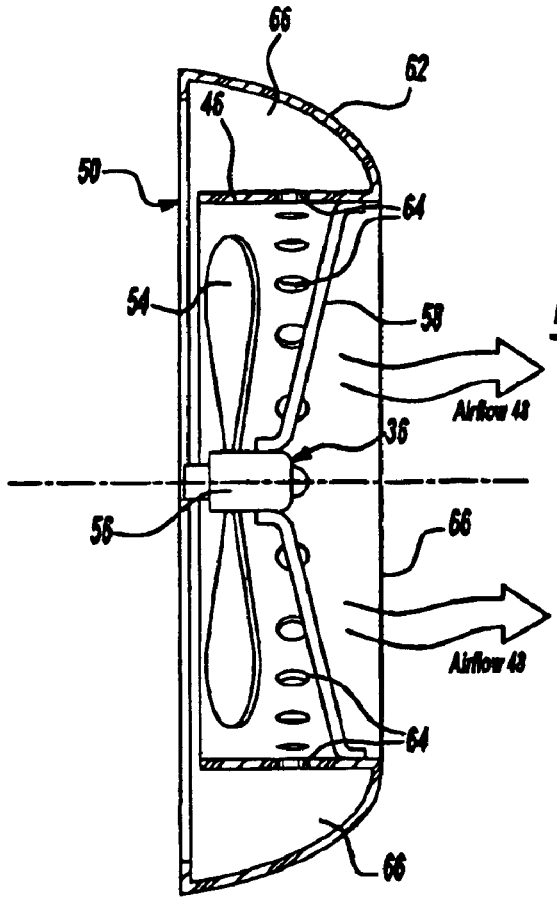
FIG. 2 illustrates a side cut away view of a first embodiment of the present invention.

FIG. 2 illustrates a side cut away view of a possible embodiment of the present invention with the fan shroud 50 attached to an outer barrel 62 having an inner surface 78 disposed around an area defining an airflow, the outer barrel 62 extending rearward of the fan 36 (i.e., downstream of the airflow). The outer barrel has an outer surface 84. The fan 36 has a motor 56, blades 54, and support arms 58. Outer barrel 62 shape and curvatures are not critical to practice the invention. At least one noise silencer, such as a Helmholtz resonator (Helmholtz resonator) is attached to the outer barrel's outer surface 84 and has a resonator cavity (cavity) 66 of a predetermined volume of airspace that connects to the airflow through an opening 64 in the outer barrel 62. As stated above, resonator cavity frequency is a function of the area of the opening 64, on the volume of the cavity 66 air space, and on the length of an air plug formed in the opening 64. The number, type, and size of the Helmholtz resonators varies by applications. They can be either broadband, narrowband, or in combination of a variety of bands, again dependent on the bandwidth of the noise to be reduced. Additionally, a noise absorbing material, such as steel wool, can also be added to the cavity 66 (not shown). The shroud 50 and outer barrel 62 of the present invention can be made from a variety of materials such as plastic or metal. The shroud 50 can be attached to a heat exchanger or similar structures using various attachment means such as welding, molding, or bolting.

Figure 3:
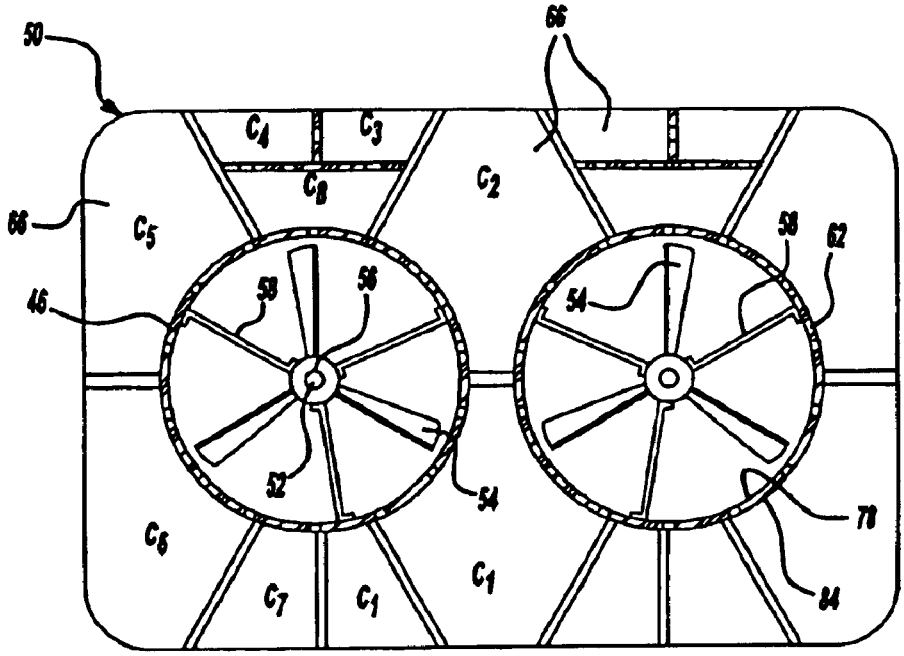
FIG. 3 illustrates a rear cut away view of second embodiment of the present invention with the resonators attached to the shroud.

FIG. 3 illustrates a rear view (viewed toward the direction of the cooling airflow 48) of a second embodiment of the present invention having multiple fans 36. This illustration also shows the Helmholtz resonator cavities 66 attached to the fan shroud 50, not the outer barrel 62, and can be arranged in series or in parallel. Cavities $C_1$, $C_5$, $C_6$, and $C_7$ represent cavities 66 arranged in a parallel configuration, while cavities $C_2$, $C_3$, $C_4$, and $C_8$ are arranged in a series configuration. These configurations are still based, as before, on application needs and cavity 66 resonant frequency is a function of the area of the opening 64, on the volume of the cavity air space, and on the length of an air plug formed in the opening 66. The series configuration particularly allows the resonator to be tuned to a lower or broader band.

Figure 4:
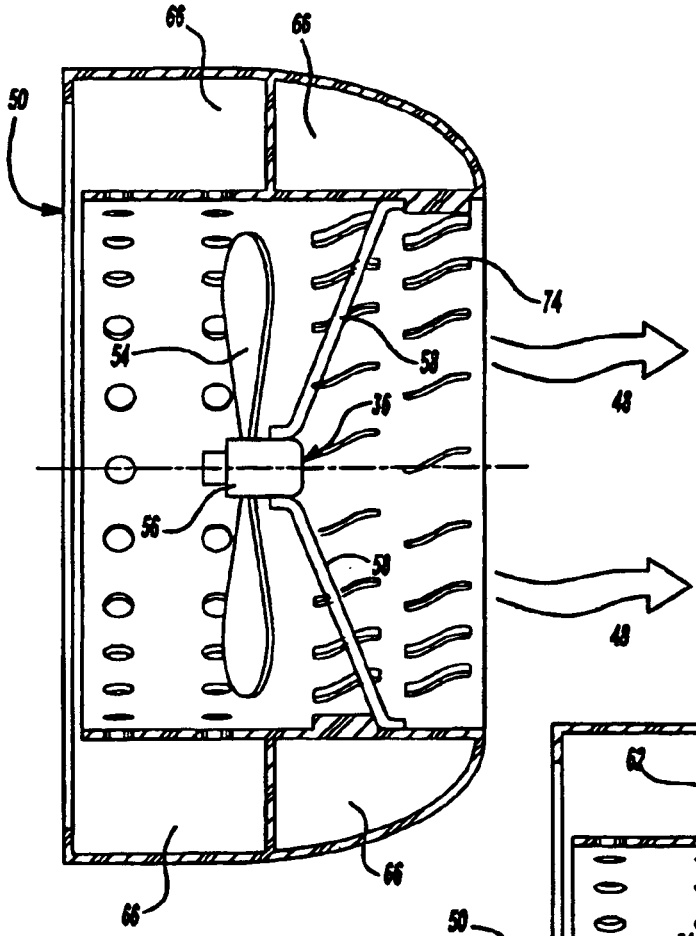
FIG. 4 illustrates a side cut away view of a third embodiment of the present invention with the outer barrel extended rearward.

FIG. 4 illustrates a side cut away view of a third embodiment of the present invention with the outer barrel 62 extended rearward. This third embodiment also adds stator members 74 to the outer barrel inner surface 78. Stators 74 can be used when the airflow needs to be redirected to make the resonators work more efficiently.

Figure 5:
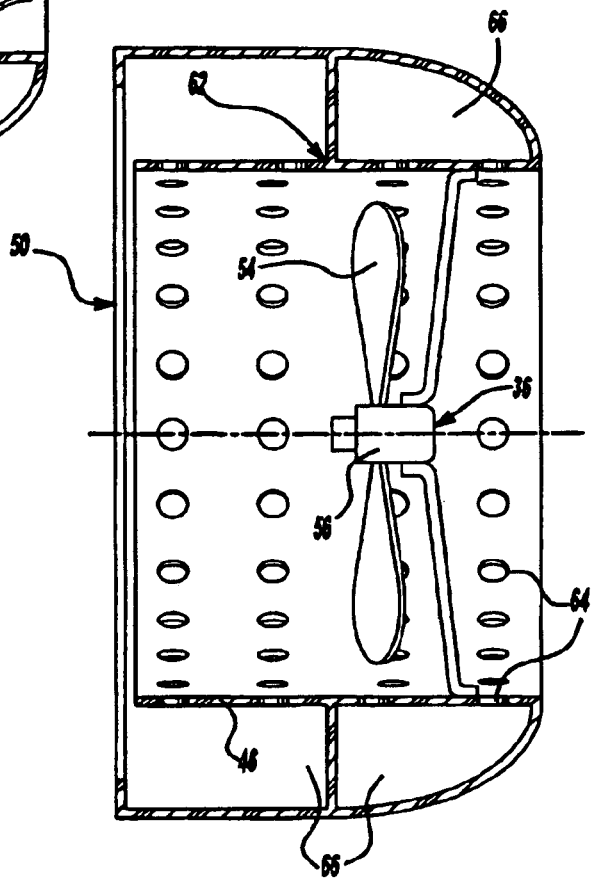
FIG. 5 illustrates a side cut away view of a fourth embodiment of the present invention with the outer barrel extended forward.

FIG. 5 illustrates a side cut away view of a fourth embodiment of the present invention with the outer barrel 62 extended forward.

Figure 6:
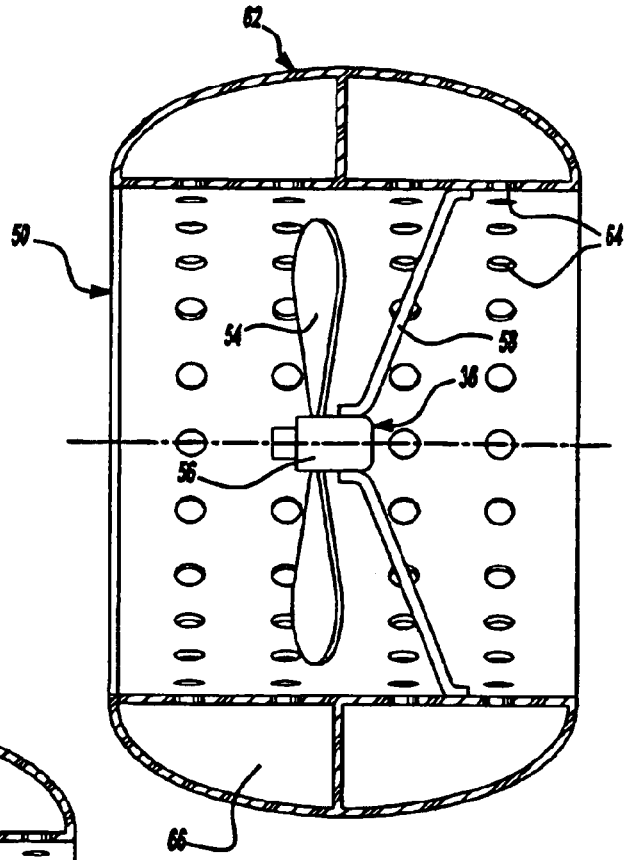
FIG. 6 illustrates a side cut away view of a fifth embodiment of the present invention with the outer barrel extended both forward and rearward.

FIG. 6 illustrates a side cut away view of a fifth embodiment of the present invention with the outer barrel 62 extended both forward and rearward.

Figure 7:
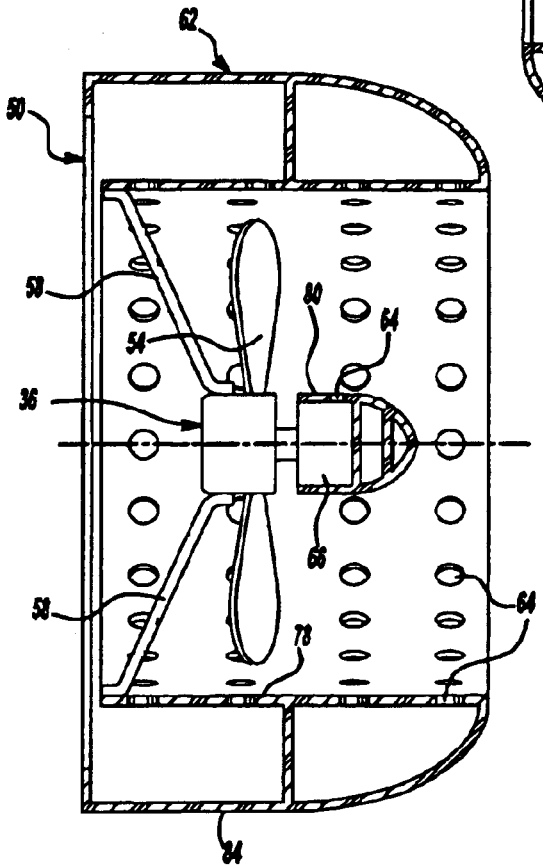
FIG. 7 illustrates a side cut away view of a sixth embodiment of the present invention with an inner barrel added behind the fan motor.

FIG. 7 illustrates a side cut away view of a sixth embodiment of the present invention with an inner barrel 80 added behind the fan 36. This inner barrel 80 can be separate from or in combination with the barrel 62. The inner barrel 80 can have at least one cavity 66 and at least one Helmholtz opening 64 to the airflow. This inner barrel 80 can be attached either upstream or downstream from the fan 36.

Additional embodiments are also possible by adding pipes between the openings 64 and the resonator cavities 66. Many various configurations using these pipes are possible and a few embodiments are illustrated below and based on airflow noise reduction and packaging considerations. The pipes can be tangential to the airflow.

Figure 8:
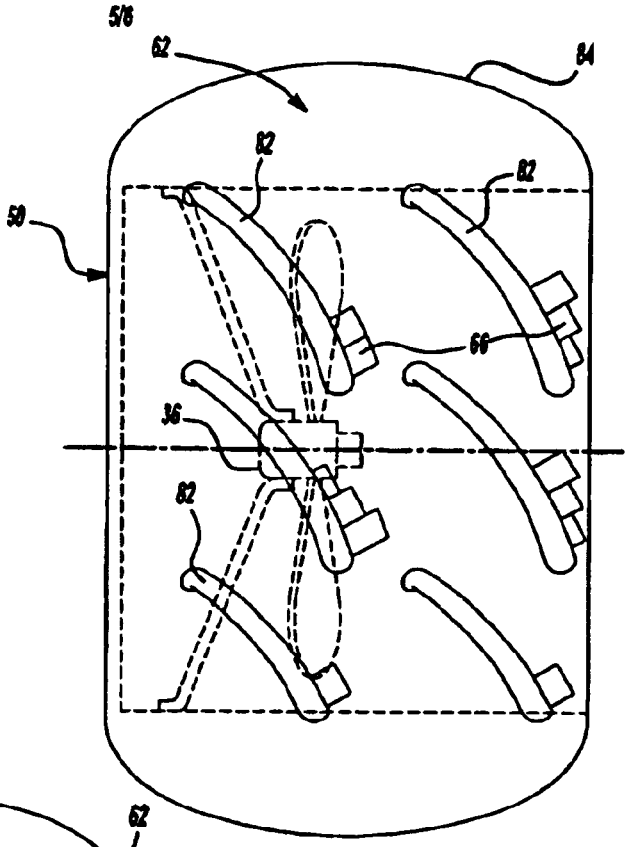
FIG. 8 illustrates a side view of a seventh embodiment of the present invention with spiral pipes and resonators connected to the outer barrel.

FIG. 8 illustrates a side view of a seventh embodiment of the present invention. This embodiment adds at least one pipe 82 in communication with at least one Helmholtz opening 64 and at least one cavity 66. In FIG. 8, the pipes 82 form spirals attached to the outer barrel outside surface 84 and in communication with cavities 66, also attached to the outer barrel outside surface 84.

Figure 9:
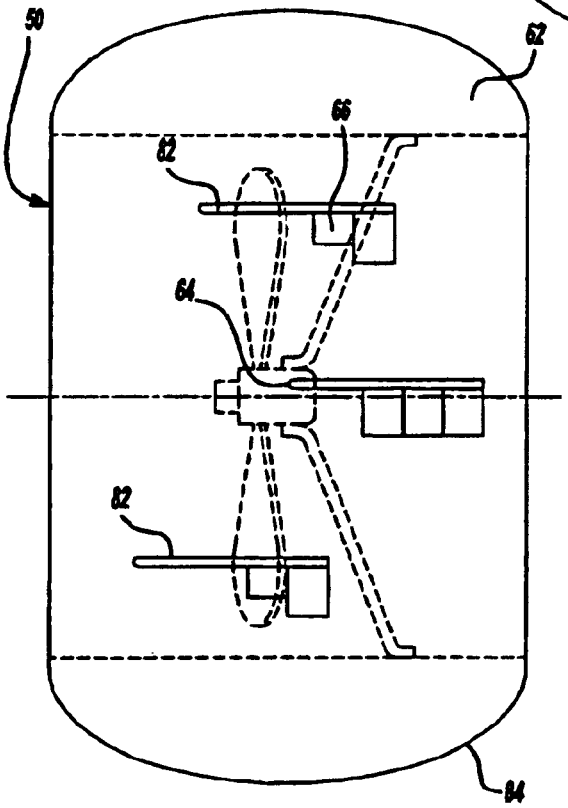
FIG. 9 illustrates a side view of an eighth embodiment of the present invention with parallel pipes and resonators connected to the outer barrel.

FIG. 9 illustrates a side view of an eighth embodiment of the present invention similar to the seventh embodiment except that the pipes 82 run parallel along the outer barrel outside surface 84.

Figure 10:
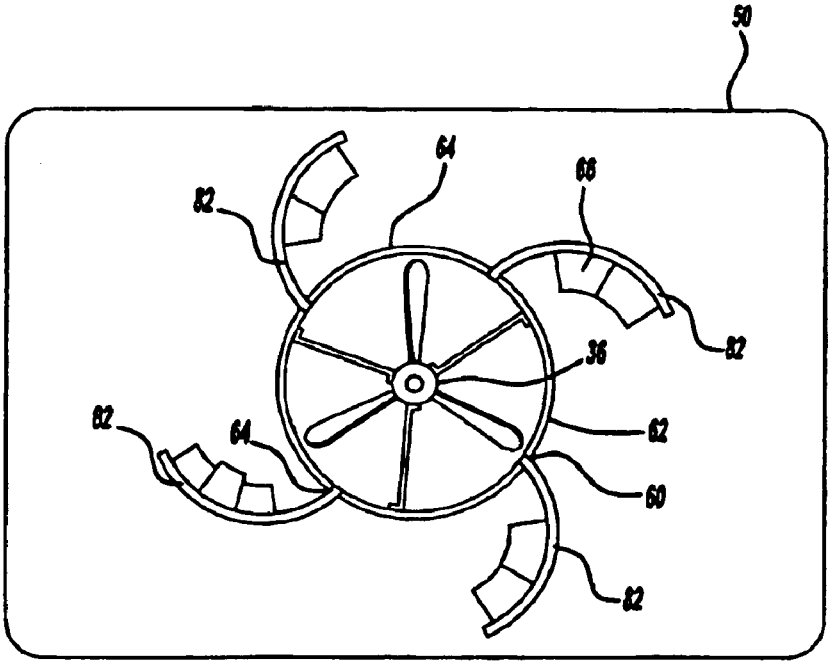
FIG. 10 illustrates a rear view of a ninth embodiment of the present invention with pipes and resonators attached to the shroud in a spiral configuration.

FIG. 10 illustrates a rear view of a ninth embodiment of the present invention. This embodiment adds at least one pipe 82 in communication with at least one Helmholtz opening 64 and at least one cavity 66. In FIG. 10, the pipes 82 form spirals attached to the shroud 50 and in communication with cavities 66 also attached to the shroud 50. The attachment can be on either side of the shroud.

Figure 11:
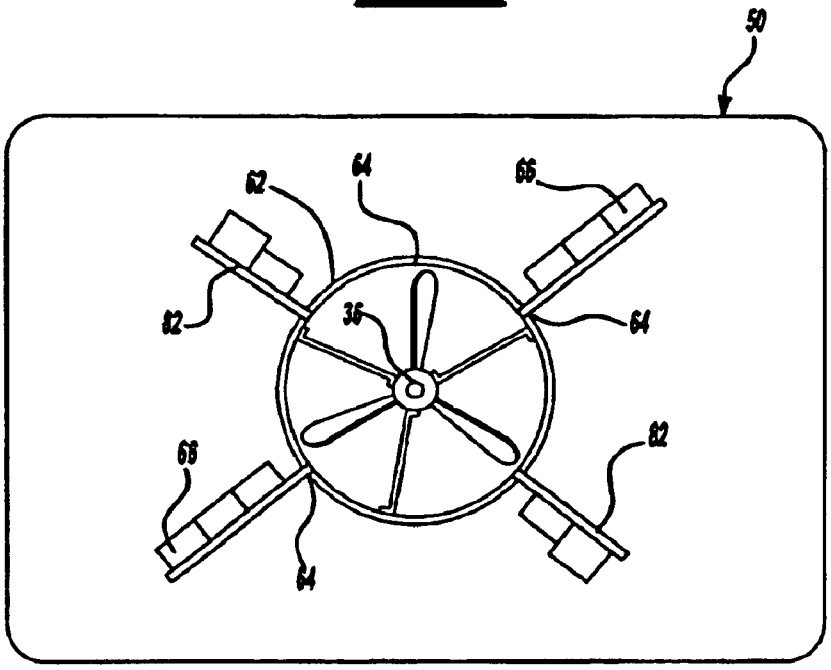
FIG. 11 illustrates a rear view of an tenth embodiment of the present invention with pipes and resonators attached to the shroud in a radial configuration from the outer barrel.

FIG. 11 illustrates a rear view of a tenth embodiment of the present invention similar to the ninth embodiment except that the pipes 82 run radially from the outer barrel 62 along the surface of the shroud 50. Again, the attachment can be on either side of the shroud 50.

In all embodiments illustrated, care is also given to optimize for airflow and packaging. The above-described embodiments of the invention are provided purely for purposes of example. Many other variations, modifications, catalysts, and applications of the invention may be made.

What is claimed is:

1. A system for noise reduction from a plurality of axial flow fans, comprising:

a shroud having an inner surface;

a plurality of outer barrels accommodating the plurality of axial flow fans, respectively, and connected to the shroud, the outer barrels each having an inner and outer surface extending from the shroud inner surface and further defining a corresponding airflow; and at least one noise silencer comprising at least one hollow cavity tuned to attenuate predetermined noise frequency ranges within the corresponding airflow, the at least one noise silencer connected to the corresponding airflow by at least one opening of a predetermined size through a corresponding one of the plurality of outer barrels.

2. The system of claim 1 wherein the at least one hollow cavity further comprises a sound absorbing material.

3. The system of claim 2 wherein the sound absorbing material is steel wool.

4. The system of claim 1 wherein the at least one noise silencer is a Helmholtz resonator.

5. The system of claim 1 wherein the at least one noise silencer is a broadband silencer.

6. The system of claim 1 wherein the at least one noise silencer is a narrowband silencer.

7. The system of claim 1 wherein the at least one noise silencer comprises a plurality of noise silencers for both narrowband and broadband application.

8. A method for reducing noise from an air moving device, comprising the steps of:

creating an airflow through a shroud and outer barrel;

communicating air from the airflow within the barrel to a cavity with an opening; and reducing airflow noise by resonating an air plug present in the opening forming a mass that resonates on a support of a spring force formed by the air enclosed in the cavity.

9. The method of claim 8 further comprising the stop of redirecting the airflow using stator members.

10. An article of manufacture for reducing noise from an air-moving device, comprising:

a shroud having an inner surface disposed around an area defining an airflow;

at least one outer barrel connected to the shroud, the outer barrel having an inner and outer surface extending from the shroud inner surface further defining the airflow;

at least one noise silencer comprising at least one hollow cavity tuned to attenuate predetermined noise frequency ranges within the airflow, the noise silencer connected to the airflow by at least one opening of a predetermined size through the outer barrel; and at least one generally spiral pipe disposed between the opening through the outer barrel and the hollow cavity.

11. The article of manufacture of claim 10 wherein the at least one noise silencer is a Helmholtz resonator.

12. The article of manufacture of claim 10 wherein the at least one noise silencer is a broadband silencer.

13. The article of manufacture of claim 10 wherein the at least one noise silencer is a narrowband silencer.

14. The article of claim 10 wherein the at least one noise silencer comprises a plurality of noise silencers for both narrowband and broadband application.

15. An article of manufacture for reducing noise from an air-moving device, comprising:

a shroud having an inner surface disposed around an area defining an airflow;

at least one outer barrel connected to the shroud, the outer barrel having an inner and outer surface extending trout the shroud inner surface further defining the airflow;

at least one noise silencer comprising at least one hollow cavity tuned to attenuate predetermined noise frequency ranges within the airflow, the noise silencer connected to the airflow by at least one opening of a predetermined size through the outer barrel; and at least one pipe disposed between the opening through the outer barrel and the hollow cavity and extending generally parallel to the airflow.

* * * * *